United States Patent [19]

Gründler

[11] Patent Number: 4,468,214

[45] Date of Patent: Aug. 28, 1984

[54] METHOD AND APPARATUS FOR SHAPING A RECTANGULAR CARTON BLANK

[75] Inventor: Bruno Gründler, Neuhausen am Rheinfall, Switzerland

[73] Assignee: SIG Schweizerische Industrie-Gesellschaft, Neuhausen am Rheinfall, Switzerland

[21] Appl. No.: 377,047

[22] Filed: May 11, 1982

[30] Foreign Application Priority Data

May 12, 1981 [CH] Switzerland ..... 3083/81

[51] Int. Cl.[3] ..... B31B 1/78; B31B 5/26

[52] U.S. Cl. ..... 493/310; 493/181; 493/182; 493/319

[58] Field of Search ..... 493/318, 319, 309, 310, 493/177, 181, 182, 407, 408, 409

[56] References Cited

U.S. PATENT DOCUMENTS 3,504,596 4/1970 Hirasuna ..... 493/310
4,197,790 4/1980 Dietrich et al. ..... 493/409 X
4,232,591 11/1980 Karpinsky ..... 493/409 X

FOREIGN PATENT DOCUMENTS 656359 3/1936 Fed. Rep. of Germany ..... 493/310
2004832 4/1979 United Kingdom ..... 493/310

*Primary Examiner*—Robert L. Spruill
*Assistant Examiner*—Donald R. Studebaker
*Attorney, Agent, or Firm*—Spencer & Frank

[57] ABSTRACT

In folding boxes forming a conveyor chain, rectangular, tubular carton blanks are introduced stepwise into two juxtaposed mirror-image designed folding stations. In the folding stations, the carton blanks are defomed by means of fingers and clamps so that their base surface is pulled into a parallelogram. The two edges forming the longer diagonal are pressed by means of stamping dies and by means of a counterholder and a stamping plate, respectively. After pressing, the carton blanks are pulled back into the folding boxes and are returned to their rectangular shape.

8 Claims, 2 Drawing Figures

METHOD AND APPARATUS FOR SHAPING A RECTANGULAR CARTON BLANK

BACKGROUND OF THE INVENTION

The present invention relates to a method for shaping a rectangular carton blank for the purpose of forming straight edges and flat side walls. The invention additionally relates to an apparatus for practicing the above method.

In the packaging art wherein cut tubular carton blanks are shaped into rectangular cartons, particularly light-weight cartons often exhibit the effect that the side walls are uneven and are easily deformed by pourable contents. From the point of view of a representative display of the goods to be sold, this is unfavorable and it is difficult to pack a plurality of such deformed cartons in cases.

According to British Patent Application No. 2,004,832, published Apr. 11, 1979, it is known to erect a flat folded tubular carton blank by pulling one of the walls of the carton blank, by means of suction cups, between spaced holders so as to partially open the blank. In an erecting station, one wall is pulled against a breaker rod and the conveyor belt presses together the leading and trailing edges of the wall resting on the conveyor belt so that the upper carton wall is bent outwardly. In this state, the carton blank is transferred to opener elements and introduced into a further processing station.

In this way, a carton blank can be opened from its folded state with the walls contacting one another. But the edges are produced only to the extent permitted by the impressed fold lines between the flat juxtaposed walls and the walls are not smoothed by the above-described process.

SUMMARY OF THE INVENTION

It is therefore an object of the present invention to provide a solution for the problem of curved walls and uneven edges discussed above.

The above object is achieved, according to the present invention, by a method for shaping a cut piece formed into a rectangular carton blank including the steps of: placing carton blanks into respective folding boxes, each comprising a rear wall and two side walls; sequentially moving the folding boxes with the carton blanks into two folding stations operating in a mirror-image arrangement; and, in each folding station:

(a) deforming the carton blank into a prism having a parallelogram shaped base surface, with one edge of the prism forming an angle remaining in the folding box and the diagonally opposite edge being pivoted out of the folding box in the direction toward the other folding station;

(b) pressing the one edge remaining in the folding box so as to press the adjacent side walls at least approximately into mutual contact;

(c) pressing the diagonally opposite edge pivoted out of the folding box until the adjacent side walls are likewise at least approximately superposed; and (d) thereafter pulling the carton blank back into the folding box so as to re-establish side walls that are aligned at right angles to one another.

The apparatus according to the invention for carrying out the above described method includes:

a plurality of folding boxes, each including a back wall and two side walls extending perpendicular to the back wall, and with the interior edge between the back wall and each side wall being concave so as to form a folding edge, a conveyor on which the folding boxes are mounted for moving the folding boxes stepwise to first and second folding stations which are arranged in a mirror-image manner; and each of the folding stations has finger means, pivotally mounted for lateral movement toward the interior of the one of the folding boxes in the respective folding station, for exerting pressure on an edge of a carton blank in the associated folding box to pivot the carton blank, a stamping die mounted for lateral movement into the associated folding box so as to cooperate with an associated folding edge to press the edge of a pivoted carton blank remaining in the folding box, a counterholder and an associated stamping plate disposed adjacent the holding box and positioned so as to receive the edge of a carton blank pivoted out of the holding box so as to press the edge pivoted out of the folding box, and at least one pivotally mounted clamp means for clamping a side of a carton blank to retract same into the folding box.

BRIEF DESCRIPTION OF THE PREFERRED EMBODIMENTS

DETAILED DESCRIPTION OF THE PREFERRED EMBODIMENTS

Figure 1:
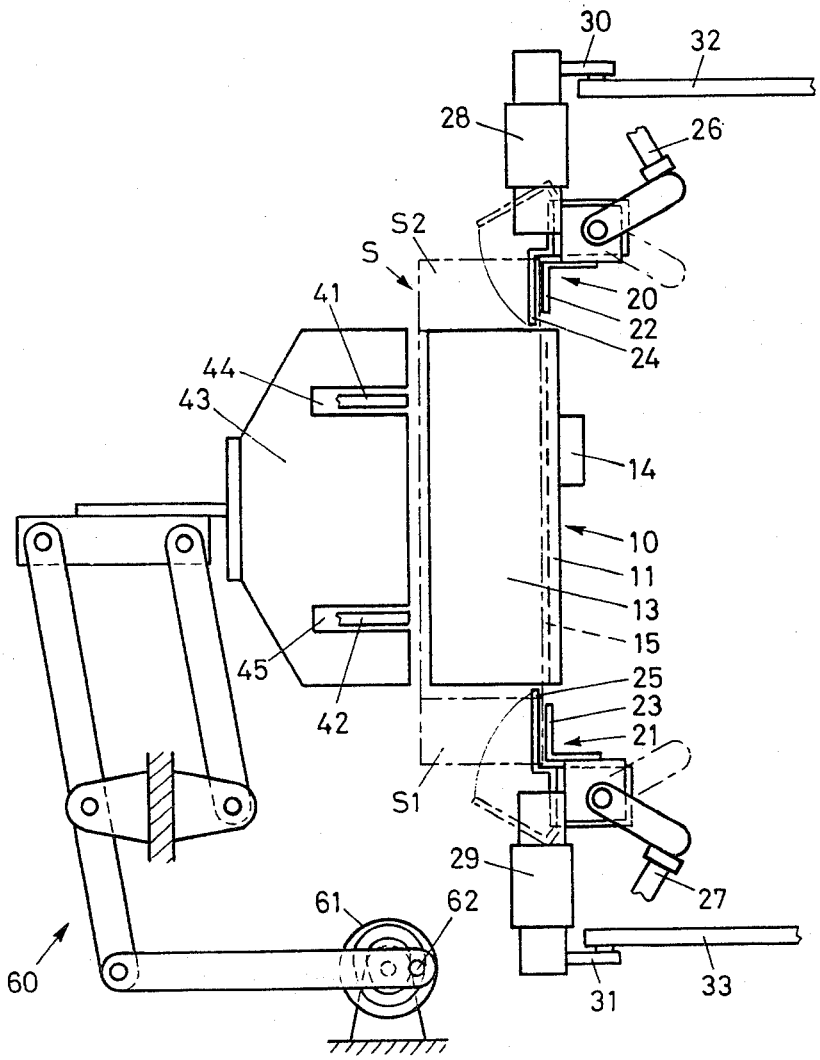
FIG. 1 is a side elevational view of an exemplary apparatus according to the invention for implementing the method according to the invention.
Figure 2:
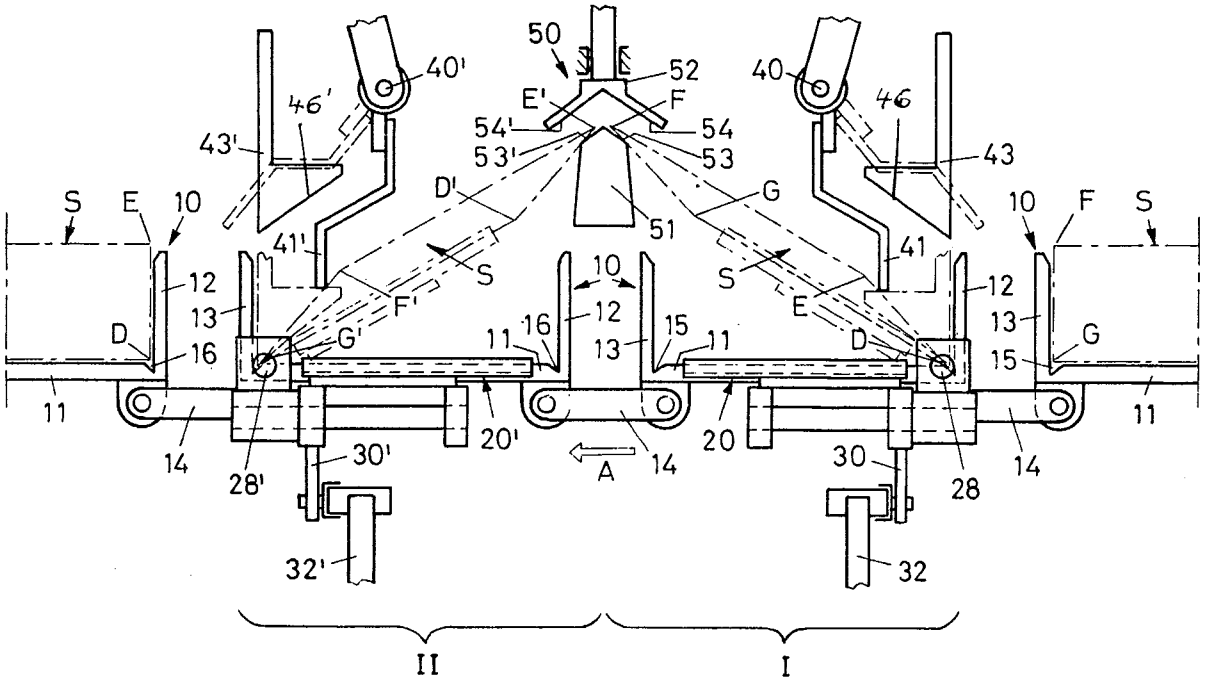
FIG. 2 is a plan view of the complete arrangement according to the invention for shaping a carton blank in folding stations which operate in a mirror-image arrangement.

Referring now to FIGS. 1 and 2, the carton blanks S are tubularly closed cut pieces, for example of cardboard, with open closing flaps S1 and S2 at bottom and top, respectively. These carton blanks S which are opened into their rectangular shape are disposed in respective folding boxes 10, each comprising a rear wall 11 and side walls 12, 13. The folding boxes 10 containing the respective shaped carton blanks S5 are transported in steps from station to station in the direction A of the production line. For this purpose, the folding boxes 10 are connected together by means of rotatably mounted chain members 14. Between the rear wall 11 and each side wall 12 and 13, each folding box 10 has a folding edge 15 or 16, respectively, which concavely enters into the rear wall 11. By means of known rigid guiding bars (not shown), the carton blanks S are secured against dropping out from the folding boxes 10.

Above and below the folding boxes 10 in each of two folding stations I and II there is an upper clamp 20 and a lower clamp 21 respectively. The clamps 20 and 21 each have a stationary arm 22 or 23, respectively, and an arm 24 or 25, respectively, which is movable relative thereto. The actuation of these movable arms 24 and 25 is effected by means of plungers 26 and 27, respectively, with the respective clamps 20 and 21 in their rest positions. As clearly shown in FIG. 2, each pair of clamps 20 and 21 is mounted via respective bearings 28 and 29 to be pivotal about a vertical axis. This pivoting is effected by means of lever arms 30 and 31 and respective pull rods 32 and 33. The two folding stations I and II are of mirror-image design. To simplify the description, the mirror-image parts are identified with the same reference numerals but with and without primes. The description mentions only the reference numeral without the prime with the intent that this always is also to apply to the same parts of the second folding station.

Each folding station I and II is provided with a finger arrangement comprising fingers 41, 42, which are rotatable about a vertical axis 40, and a stamping die 43 which moves laterally into the folding box adjacent the side wall 12 in station I and into folding edge 16. The stamping die 43 is provided with recesses 44 and 45 for the intersection with fingers 41 and 42, respectively. The fingers 41, 42 are driven in a known manner by means of a cam 61 and sensor rollers 62 as is the drive for the stamping die 43. The two cams may here be fastened on the same drive shaft since the movements of the fingers 41 and 42 and of the stamping die 43 tak place with an offset in time.

Between the two folding stations I, II there is an edge stamping station 50 common to both stations I and II and including a counterholder 51 and a stamping plate 52. As can be seen in FIG. 2, the counterholder 51 and the stamping plate 52 of each folding station have parallel working faces 53, 54. The working faces 53 and 53' of the counterholder 51 and the working faces 54 and 54' of the stamping plate 52 common to each of the two different folding stations I, II each enclose an obtuse angle. In the plan view of FIG. 2, this angle results from the connecting lines between the folding edges 15 and 16, respectively, and the center point of the counterholder 51. Moreover, the stamping die 43 has a stamping face 46 which extends substantially parallel to the connecting line between the folding edge 16 and the surface 53 of the counterholder 51.

The above described drive with cam 61 and sensor roller 62 for the stamping dies 43, 43' could be combined with the drive for the stamping plate 52. In that case, a system of guide and drive levers 60 as shown in FIG. 1 common to all three stamping members could be provided.

Such a shaping arrangement operates as follows:

By means of folding boxes 10 in the form of a conveyor chain, preformed rectangular carton blanks S are advanced in steps in the direction A to reach the folding stations I and II. By means of the pivotal upper clamps 20, 20' and lower clamps 21, 21', the walls of the carton blanks resting against the rear walls 11 and 11', respectively, are gripped at their lower and upper closing flaps S1 and S2, respectively. The fingers 41, 41' are then pivoted from the rest position shown in dashed lines to the operating position shown in solid lines and in so moving exert pressure on the side surfaces E and F', respectively. Simultaneously the clamps 20, 20' and 21, 21' are pivoted about their axes causing the base of the cartons S and S' to be pulled into respective parallelogram shapes. Thus the carton blanks S are pressed flat and pivoted out of the folding boxes 10 to take on the position shown in dashed. lines in FIG. 2. One edge D or G' of each blank S remains in the folding box 10 of folding station I or II, respectively, and one edge F or E', respectively, enters the area of the edge stamping station 50. In this position of the carton blanks S, the stamping dies 43 and 43' are introduced into the folding boxes 10 and press the respective edges D and G' into the folding edges 16 and 15, respectively. At the same time, the stamping plate 52 is also pressed against the counterholder 51 to shape the edges F, E'. The spacing between the two folding stations I and II and the location of the counterholder 51 is such that when the edges F and E' are pressed by the stamping plate 52, the edges F and E' approximately contact one another. After resetting fingers 41, 41', stamping dies 43, 43' and stamping plate 52 into their rest positions, the carton blanks S are pulled back into the respective folding boxes 10 by means of the pivotal clamps 20, 21 and 20', 21', respectively, and are returned to their rectangular shape. Therefore the clamps 20, 20', 21, 21' are released and the holding boxes advanced one step in the direction A so that the blank S which was previously at folding station I is now at folding station II, and then the process is repeated.

As a result of the deformation of the carton blank S in two directions by the above-described method, the edges are broken, thus reinforcing the walls of the carton produced by connecting the bottom and lower flaps.

It will be understood that the above description of the present invention is susceptible to various modifications, changes and adaptations, and the same are intended to be comprehended within the meaning and range of equivalents of the appended claims.

What is claimed is:

1. Method for shaping a cut piece formed into a rectangular carton blank for the purpose of forming straight edges and flat side walls, comprising the steps of: placing carton blanks into respective folding boxes, each comprising a rear wall and two side walls; sequentially moving the folding boxes with the carton blanks into two folding stations operating in a mirror-image arrangement; and, in each said folding station (a) deforming the carton blank into a prism having a parallelogram shaped base surface, with one edge of said prism forming an angle remaining in the folding box and the diagonally opposite edge being pivoted out of the folding box in the direction toward the other folding station;

(b) pressing said one edge remaining in the folding box so as to press the adjacent side walls at least approximately into mutual contact;

(c) pressing said diagonally opposite edge pivoted out of the folding box until the adjacent side walls are likewise at least approximately superposed; and (d) thereafter pulling the carton blank back into the folding box so as to re-establish side walls that are aligned at right angles to one another.

2. A method as defined in claim 1 wherein said step of deforming the carton blank includes exerting pressure on one of the leading edges of the carton blank.

3. A method as defined in claim 1 wherein said step of pressing said one edge remaining in the folding box and said step of pressing said diagonally opposite edge pivoted out of the folding box take place at least approximately simultaneously.

4. Apparatus for shaping a cut piece formed into a rectangular carton blank for the purpose of forming straight edges and flat side walls comprising:

a plurality of folding boxes, each including a back wall and two side walls extending perpendicular to said back wall, and with the interior edge between said back wall and each said side wall being concave so as to form a folding edge, a conveyor on which said folding boxes are mounted for moving said folding boxes stepwise to first and second folding stations which are arranged in a mirror-image manner; and each of said folding stations including finger means, pivotally mounted for lateral movement toward the interior of the one of said folding boxes in the respective said folding station, for exerting pressure on an edge of a carton blank in said one of said folding boxes to pivot the carton blank, a stamping die mounted for lateral movement into said one of said folding boxes so as to cooperate with an associated one of said folding edges to press the edge of a pivoted carton blank which remains in the folding box, a counterholder and an associated stamping plate disposed adjacent the holding box and positioned so as to receive the edge of a carton blank pivoted out of the holding box and to press the edge pivoted out of the folding box, and at least one pivotally mounted clamp means for clamping a side of a carton blank to retract same into said folding box.

5. Apparatus as defined in claim 4 wherein the space between said first and second folding stations is dimensioned such that the edges of the two carton blanks in both of said folding stations which are pivoted out of the respective folding boxes at least approximately contact one another when said edges are in their at least approximately pressed together state.

6. Apparatus as defined in claim 4 wherein said finger means of said first and second folding stations are arranged on the sides of said folding stations which are away from one another.

7. Apparatus as defined in claim 6 wherein said counterholder and said stamping plate are common to both of said folding stations.

8. Apparatus as defined in claim 7 wherein said stamping die has a stamping face which extends at least approximately parallel to the connecting line between the one of said folding edges in the respective said folding box in which the edge of the associated carton blank is formed, and the associated contact face of said counterholder.

* * * * *